United States Patent [19]

Epperly et al.

[11] 4,332,667

[45] Jun. 1, 1982

[54] LIQUEFACTION PROCESS FOR SOLID CARBONACEOUS MATERIALS CONTAINING ALKALINE EARTH METAL HUMATES

[75] Inventors: William R. Epperly, Summit; Barry C. Deane, East Brunswick, both of N.J.; Roy J. Brunson, Buffalo Grove, Ill.

[73] Assignee: Exxon Research & Engineering Co., Florham Park, N.J.

[21] Appl. No.: 922,908

[22] Filed: Jul. 10, 1978

[51] Int. Cl.[3] ..... C10G 1/04

[52] U.S. Cl. ..... 208/8 LE

[58] Field of Search ..... 208/8 LE

[56] References Cited

U.S. PATENT DOCUMENTS

| | | | |
|---|---|---|---|
| 2,722,498 | 11/1955 | Morrell et al. | 208/8 LE |
| 3,503,865 | 3/1970 | Stone | 208/8 LE |
| 3,808,119 | 4/1974 | Bull et al. | 208/8 LE |
| 4,108,759 | 8/1978 | Young | 208/8 LE |
| 4,121,910 | 10/1978 | Stambaugh | 208/8 LE |

OTHER PUBLICATIONS

EDS Coal Liquefaction Process Development Phase III A, Monthly Technical Progress Report for Dec. 31, 1976, Exxon Research and Engineering Co., published Feb. 1977, p. 8.

EDS Coal Liquefaction Process Development Phase III A, Monthly Technical Progress Report for Jan.-Jul. 31, 1976, Exxon Res. & Eng. Co., published Jul. 1977.

EDS Coal Liquefaction Process Development Phase III A, Annual Technical Progress Report for Jan.-Dec. 31, 1976, Exxon Res. & Eng. Co., submitted Dec. 1977.

EDS Liquefaction Process Development Phase III A, Quarterly Technical Progress Report for Jan.-Mar. 31, 1977, Exxon Res. & Eng. Co., submitted Dec. 1977.

*Primary Examiner*—Delbert E. Gantz
*Assistant Examiner*—Joseph A. Boska
*Attorney, Agent, or Firm*—Wayne Hoover

[57] ABSTRACT

An improved liquefaction process wherein wall scale and particulate agglomeration during the liquefaction of solid carbonaceous materials containing alkaline earth metal humates is reduced and/or eliminated by subjecting the solid carbonaceous materials to controlled cyclic cavitation during liquefaction. It is important that the solid carbonaceous material be slurried in a suitable solvent or diluent during liquefaction. The cyclic cavitation may be imparted via pressure cycling, cyclic agitation and the like. When pressure cycling or the like is employed an amplitude equivalent to at least 25 psia is required to effectively remove scale from the liquefaction vessel walls.

6 Claims, 1 Drawing Figure

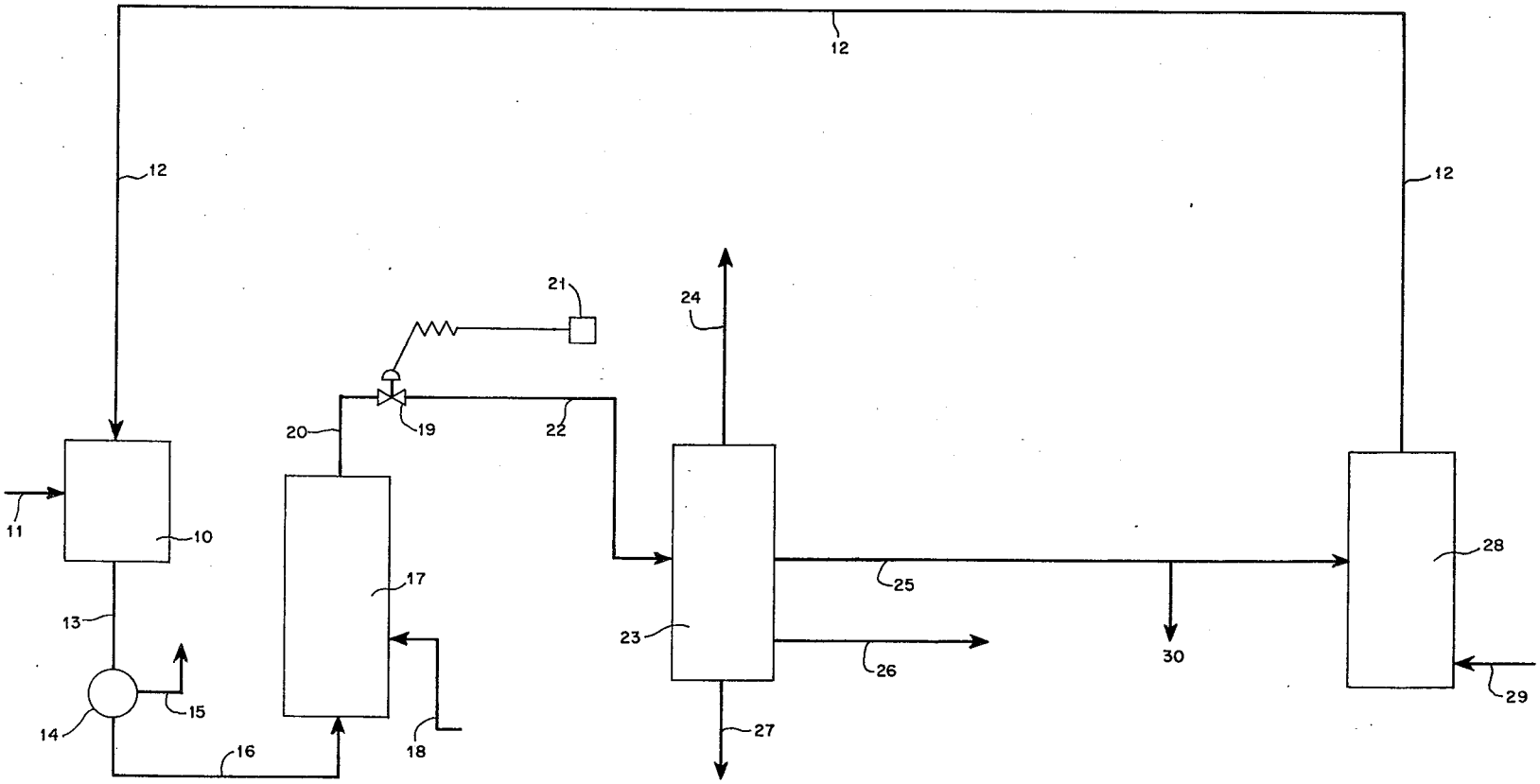
10
11
12
12
12
13
14
15
16
17
18
19
20
21
22
23
24
25
26
27
28
29
30

LIQUEFACTION PROCESS FOR SOLID CARBONACEOUS MATERIALS CONTAINING ALKALINE EARTH METAL HUMATES

The Government of the United States of America has rights in this invention pursuant to Contract No. E(49-18)-2353 awarded by the U.S. Energy Research and Development Administration.

BACKGROUND OF THE INVENTION

1. Field of the Invention

This invention relates to an improved process for converting coal or similar solid carbonaceous material containing certain mineral matter. More particularly, this invention relates to an improved process for liquefying coal and similar carbonaceous materials.

2. Description of the Prior Art

As is well known, coal has long been used as a fuel in many areas. For several reasons, such as handling problems, waste disposal problems, pollution problems and the like, coal has not been a particularly desirable fuel from the ultimate consumers point of view. As a result, oil and gas have enjoyed a dominant position, from the standpoint of fuel sources, throughout the world.

As is also well known, proven petroleum and gas reserves are shrinking throughout the world and the need for alternate sources of energy is becoming more and more apparent. One such alternate source is, of coarse, coal since coal is an abundant fossil fuel in many countries throughout the world. Before coal will be widely accepted as a fuel, however, it is believed necessary to convert the same to a form which will not suffer from the several disadvantages alluded to previously.

To this end, several processes wherein coal is either liquefied and/or gasified have been proposed heretofore. Of these, the processes wherein coal is liquefied appear to be more desirable in most cases since a broader range of products is produced and these products are more readily transported and stored. Difficulty has, however, been encountered during the liquefaction of certain coals, particularly the lower ranking coals, apparently as the result of certain compounds contained in these coals.

While the inventors here do not wish to be bound by any particular theory, it is believed that the operating difficulties are associated with the presence of one or more alkaline earth metals, particularly calcium, and to some extent, the presence of iron which reacts during liquefaction with available anions to form a solid which may deposit on the reactor wall as scale. A large portion of the scale remains in the Liquefaction reactor thereby reducing reactor volume, and hence, the liquefaction contacting time and/or the total throughput. Ultimately, complete plugging may occur. Moreover, a portion of the scale or deposit remains in the liquid product and can cause downstream plugging problems.

The scaling and/or deposit problem is believed to have been first reported upon in the literature in connection with the operation of a high pressure coal liquefaction plant for producing liquids from lignites at Wesseling, near Cologne, Germany. According to the literature, operation of this plant was severely limited by a solid referred to as "caviar", the reference apparently stemming from the appearance of the solid in the form of agglomerated balls or spherulites. According to the literature, the spherulites were found to comprise calcium carbonate and hexagonal crystals of iron sulfide.

Early attempts to solve the problem involved the use of what might be termed engineering techniques which were designed either to prevent scale formation or to remove the scale before operating problems were encountered. In one such technique, a small slipstream was withdrawn from an initial reactor of a series in a process. With this technique, the initially formed small particles were continuously withdrawn and removed and the slipstream then returned to the reactor. This technique aided in suppressing further crystal growth and slowed down the rate of scale formation within the reactor. The technique did, however, result in high gas losses and high erosion rates within auxiliary equipment.

More recently, it has been discovered that calcium carbonate deposits which formed during liquefaction as the result of the decomposition of various calcium organic compounds can be avoided by converting the calcium organic compounds which do decompose during liquefaction to a salt which will remain stable during liquefaction or to a form which can be removed prior to liquefaction. Conversions of this type can be effected with a relatively broad range of pretreating agents including salts of metals different from calcium which will, effectively, replace the calcium in the coal, various organic and inorganic acids and certain gaseous pretreating agents such as $SO_2$ and $SO_3$.

For the most part, these ion exchange-type pretreatments have been quite effective in solving the scale or deposition problem. Most such treatments, however, involve the use of aqueous solutions of pretreating agents thereby increasing the amount of water which must be removed either prior to or during liquefaction. Moreover, many of these pretreatments increase the amount of ash or residue which must ultimately be disposed of and/or involve the use of pretreating agents which are known pollutants and therefore which must be separated from any gas stream ultimately vented to the atmosphere and some of which are hazardous in their own right. The need, therefore, for an improved method of avoiding the scale and/or solid deposition problem is believed to be readily apparent.

SUMMARY OF THE INVENTION

It has been surprisingly discovered that the foregoing and other disadvantages of the prior art processes for the Liquefaction of coal can be avoided or overcome by the method of the present invention and an improved method for liquefying lower ranking coals provided thereby. It is, therefore, an object of this invention to provide an improved liquefaction process. It is still another object of this invention to provide such an improved process which is not subject to significant scaling and/or solid agglomeration problems. It is still another object of this invention to provide such a process wherein mechanical means are employed to reduce or avoid the scaling and/or solids agglomeration problem. It is yet another object of this invention to provide such a process wherein the chemical composition of the solid residue from the liquefaction process is not altered by chemical pretreatment. These and other objects and advantages will become more apparent from the description set forth hereinafter and the figures appended hereto.

In accordance with the present invention, the foregoing and other objects and advantages are accomplished by subjecting the coal or similar carbonaceous material to cyclic cavitation during liquefaction. As indicated before, the cyclic cavitation may be accomplished by pressure cycling, high speed agitation and the like. As also indicated more fully hereinafter, the cyclic cavitation effectively disrupts scale formation on the reactor wall and causes the scale to pass through the Liquefaction zone where the same is ultimately separated from the liquid and gaseous products as a component of the solid residue.

BRIEF DESCRIPTION OF THE DRAWINGS

The drawing is a schematic flow diagram of a coal liquefaction process within the scope of the present invention.

DETAILED DESCRIPTION OF THE INVENTION

As indicated supra, the present invention relates to an improved liquefaction process wherein a mechanical disruption is employed so as to avoid scale build-up on the liquefaction vessel walls during the liquefaction of a coal and similar solid carbonaceous materials containing alkaline earth metal humates. As also indicated supra, the physical disruption is imposed periodically by using cyclic cavitation techniques. The physical disruption can, then, be effected by employing any of the known cyclic cavitation techniques such as pressure cycling, and high speed agitation.

In general the improved method of this invention can be used with any coal containing one or more alkaline earth metal humates and particularly any coal containing calcium humate. Such coals include subbituminous coal, lignite, peat, brown coal and similar solid carbonaceous materials.

In general, the method of this invention may be used in combination with any process known to be effective for the liquefaction of coal or other solid carbonaceous materials wherein a liquid or solid diluent is employed. In such processes, liquefaction of the coal or similar carbonaceous material is effected by subjecting a mixture of the coal or solid carbonaceous material and the solvent to an elevated temperature and pressure for a period of time sufficient to permit at least partial liquefaction of the coal. As is well known, conversion of the solid carbonaceous materials to a liquid requires hydrogen and the hydrogen may be provided via any method known to be effective in the prior art including the use of molecular hydrogen, hydrogen-donor solvents, other materials known to yield hydrogen at liquefaction conditions and combinations of these. The liquefaction, which is effectively, then, a hydrogenation, may be effected either with or without an added catalyst.

In general, the coal which is subjected to liquefaction will be ground, prior to liquefaction, to a finely divided state. The particular particle size or particle size range actually employed will depend upon the optimum size for the particular liquefaction technique employed. Nonetheless, the coal will, generally, be ground to a particle size of less than about ¼-inch and preferably to a particle size of less than about 8 mesh NBS sieve size.

After the coal has been ground the same will, generally, be slurried with a suitable solvent or diluent. Again, any of the solvents or diluents known to be useful in the prior art can be used in the liquefaction method of the present invention. Such solvents or diluents include all types of hydrocarbons and oxygenated hydrocarbons and particularly those having a boiling point within the range from about 400° to about 1000° F. The solvent or diluent may be a straight or branched-chained hydrocarbon, a cyclic hydrocarbon, a naphthenic or aromatic hydrocarbon, a phenol or substituted phenol, a hydroaromatic, heterocyclic compounds which may contain oxygen, nitrogen or sulfur, or mixtures of any one or more of these materials. Moreover, the solvent or diluent may be inert at the liquefaction conditions or the same may donate hydrogen at these conditions. Particularly effective solvents include hydrogenated creosote oils and solvents derived from the coal liquefaction process particularly those boiling within the range from about 400° to about 900° F. The solvent derived from the coal liquefaction itself is particularly effective when the same has been at least partially hydrogenated to produce a solvent containing hydrogen-donor species. Such species are believed to be well known in the prior art and many are described in U.S. Pat. No. 3,867,275.

Generally, the solvent and/or diluent will be combined with the coal at a solvent:coal ratio within the range from about 1:1 to about 4:1. Best results are, however, generally obtained when this ratio is within the range between about 1.2:1 and 2:1 and operation within this range is, therefore, preferred.

In general, the liquefaction will be accomplished at a temperature between the range from about 700° F. and about 900° F. and at a pressure within the range from about 1000 to about 3000 psig. Generally, the coal/solvent slurry will be held at conditions within the aforesaid specified ranges for a period of time within the range from about 10 to about 200 minutes. As is well known, the liquefaction may be accomplished in a plurality of stages and when multiple stages are employed, maximum reduction in scale formation will be realized when each stage is subjected to cyclic cavitation. As indicated more fully hereinafter, however, significant reduction in scale formation will be realized when only the first stage is subjected to cyclic cavitation.

When pressure cycling is employed to effect the desired cyclic cavitation, the desired pressure cycling may be accomplished via any of the techniques which will be readily apparent to those of ordinary skill in the art. For example, pressure cycling may be accomplished by cycling a pressure control valve positioned on essentially any inlet or outlet to the liquefaction reactor or zone. Such inlets and outlets include the slurry feed inlet, the product outlet or outlets, and any vent line that may be provided from the liquefaction reactor or zone. Best results will, however, be achieved when the pressure control valve is located downstream of the liquefaction zone. Best results will also be obtained when the slurry passes through the liquefaction zone in a manner such that the continuous phase is liquid since the pressure fluxuation is most effective when the reactor is primarily filled with liquid. This is most easily accomplished by sending the slurry upflow through the liquefaction zone. Moreover, best results will, generally, be realized in staged operations when the pressure is cycled in each stage.

When pressure cycling is employed to effect the cyclic cavitation, the coal/solvent slurry will be subjected to pressure variation having an amplitude within the range from about 25 to about 500 psi. The frequency of variations will, generally, be within the range from about 0.1 to about 10 cycles per minute.

While the inventors do not wish to be bound by any particular theory it is believed that insoluble salts tend to form at the reactor wall and in the bulk phase. The crystals of these salts tend to grow with time and can form wall scale or larger deposits in the bulk phase of the reactor. Cyclic cavitation disrupts the growth of these crystals and prevents the formation of large deposits which can disrupt operations. Also, and while the inventors still do not wish to be bound by any particular theory, it is believed that a pressure variation of at least 25 psia will be required to effect the desired liberation of the scale from the liquefaction zone walls.

After the liquefaction is completed the products, which will comprise gases, liquids and solids, will be withdrawn from the liquefaction zone, separated and processed in accordance with conventional techniques. For example, the gaseous products may be burned to provide energy for the liquefaction process, sold as fuels or reformed to provide hydrogen for the process. The liquids may be fractionated into a desired product distribution and may be used directly as fuels or upgraded using conventional techniques. Similarly, the solvent may be recovered and recycled or the same may be blended into one or more of the product streams. Finally, the bottoms from the liquefaction process which will contain the liberated scale and agglomerates may be coked, used as a fuel or subjected to other treatments known in the prior art.

PREFERRED EMBODIMENT

In a preferred embodiment of the present invention, pressure cycling will be used to effect the desired cyclic cavitation in combination with a single-staged liquefaction zone. An amplitude of at least 50 psia will be employed, most preferably an amplitude within the range from about 50 to about 100 psia will be employed, and the pressure will be cycled over this amplitude at a frequency within the range from about 1 to about 3 cycles per minute. Moreover, the liquefaction will be accomplished in the presence of a hydrogen-donor solvent and in the presence of added molecular hydrogen. Also in a preferred embodiment the liquefaction will be accomplished at a temperature within the range from about 800° F. to about 880° F. at a pressure within the range from about 1500 to about 2000 and at a nominal holding time within the range from about 20 to about 60 minutes.

In the preferred embodiment, a lower ranking coal and, in a most preferred embodiment, a subbituminous coal will be ground to a particle size of less than about ⅛-inch and slurried with a donor solvent. The donor solvent will be derived from the coal liquids and will be hydrogenated prior to recycle to the Liquefaction zone. Also in the preferred embodiment, the coal will be dried to a moisture content within the range from about 1 to about 10 weight percent. The drying may be accomplished either prior to or after the particulate coal is slurried with the solvent.

It is believed that the invention will be better understood by reference to the attached figures which illustrate a particularly preferred embodiment. Referring then to the drawing, a finely divided lower ranking coal is introduced into mixing vessel 10 through line 11 and slurried with recycle solvent which is introduced through line 12. As indicated hereinafter, the recycle solvent is hydrogenated prior to introduction into mixing vessel 10. The coal/solvent slurry is then withdrawn from the mixer through line 13 and passed through heat exchanger 14. In the heat exchanger, sometimes referred to hereinafter as the preheater, the slurry will be heated to a temperature within the range from about 300° F. to about 400° F. and in the embodiment illustrated steam will be withdrawn through line 15 so that the moisture content of the coal in the slurry will be within the range from about 1 to about 10 weight percent when the slurry is withdrawn through line 16 and fed to liquefaction vessel 17. In the liquefaction vessel, the coal/solvent slurry is combined with molecular hydrogen which is introduced through line 18. Generally, hydrogen will be added in an amount within the range from about 2 to about 8 weight percent based on dry coal. In the preferred embodiment, the liquefaction vessel will be sized so as to provide a nominal holding time within the range from about 20 to about 60 minutes and heat will be added or removed as required to maintain a temperature in the liquefaction vessel within the range from about 800° F. to about 880° F. Pressure in the liquefaction vessel will be maintained at a value within the range from about 1500 to about 2000 psia with control valve 19 which is located in product withdrawal line 20. Control valve 19 will also be employed to impart cycling of the pressure at a predetermined amplitude within the range from about 50 to about 100 psia and at a frequency within the range from about 1 to about 3 cycles per minute. The frequency will be controlled electronically by timer 21 and the amplitude will be controlled manually by limiting the movement of the valve trim (not shown) in response to the signal transmitted by timer 21.

In the embodiment illustrated, it is important that liquid continuity is maintained throughout the liquefaction vessel 17 so that the pressure cycle generated by valve 19 is transmitted throughout the liquefaction vessel 17. Such liquid continuity is, of course, easily achieved by operating the liquefaction vessel 17 such that the slurry flows upwardly.

After the products from the liquefaction vessel pass through pressure control valve 19 they are then fed through line 22 to atmospheric fractionator 23. At this point, the product stream comprises product gases, product liquids, spend solvent, dissolved coal and mineral matter. In the atmospheric fractionator 23, the product stream is separated to a more desirable distribution. Essentially any distribution could, of course, be obtained but in the embodiment illustrated, the gaseous components and the lighter liquid hydrocarbon products are taken overhead through line 24. A middle fraction comprising the spent solvent as well as liquid product boiling in the range of the spent solvent is withdrawn through line 25. A heavier liquid product is then withdrawn through line 26 and may be further separated using conventional techniques such as vacuum fractionation. The undissolved coal and the solid mineral matter is withdrawn through line 27. Again, the unreacted coal and the mineral matter may be subjected to further treatment such as coking and/or gasification using conventional techniques.

In the preferred embodiment, the solvent fraction withdrawn through line 25 will be hydrogenated before the same is recycled to mixing vessel 10. Preferably, the hydrogenation will be accomplished catalytically at conditions known to be effective for this purpose in the prior art. In the embodiment illustrated, the hydrogenation is accomplished in hydrogenation vessel 28 with a gas comprising molecular hydrogen or a hydrogen donor introduced through line 29. The hydrogenated product is then recycled to mixing vessel 10 through line 12. In those cases where the amount of liquid withdrawn through line 25 exceeds the amount of solvent required during liquefaction, any excess may be withdrawn through line 30 prior to hydrogenation.

Normally, the hydrogenation will be accomplished at a temperature within the range from about 650° to about 850° F. and at a pressure within the range from about 650 to 2000 psia. The hydrogen treat rate during the hydrogenation generally will be within the range from about 1000 to about 10,000 SCF/BBL. Any of the known hydrogenation catalysts may be employed but a nickel-moly catalyst is most preferred.

Having thus broadly described the present invention in a preferred embodiment thereof, it is believed that the same will become even more apparent by reference to the following examples. It will be appreciated, however, that the examples are presented solely for purposes of illustration and should not be construed as limiting the invention.

EXAMPLE 1

120 pounds of a "as received" Wyodak coal (containing 32 percent water) was dried to a moisture content of about 4 percent and then ground to a particle size ranging less than about 100 mesh (NBS). The dried coal was then slurried with a hydrogenated creosote oil solvent and passed through a tubular liquefaction vessel. The average conditions throughout the run which lasted for 6 days were 840° F., 1500 psig and a nominal slurry residence time of 60 minutes. A pressure control valve was employed to impart a 50 psia fluxuation in the pressure at a frequency of 3 cycles per minute. After the run was completed, the tubular reactor was inspected for scale and it was determined that the upflow portions of the reactor contained only 1/10 gram material which was larger than the feed coal. On the other hand, the downflow portion, wherein pressure cycling is not effective, contained over 5 grams scale.

EXAMPLE 2

In this example, the run of example 1 was repeated except that the pressure was maintained constant at 1500 psia throughout the run. At the end of the run the tubular run was again inspected and it was found that 8 grams of scale had formed.

From the foregoing it is believed readily apparent that pressure cycling is effective in reducing wall scale deposits.

While the present invention has been described and illustrated by reference to particular embodiments thereof it will be appreciated by those of ordinary skill in the art that the same lends itself to variations not necessarily illustrated herein. For this reason, then, reference should be made solely to the appended claims for purposes of determining the true scope of the present invention.

Having thus described and illustrated the invention what is claimed is:

1. In a process wherein a lower ranking coal or similar solid carbonaceous material is slurried in a suitable solvent or diluent and liquefied at an elevated temperature and pressure, the improvement comprising subjecting the coal slurry to pressure variation having an amplitude within the range from about 25 to about 500 psi at a frequency within the range from about 0.1 to about 10 cycles per minute during liquefaction.

2. The improvement of claim 1 wherein the liquefaction is accomplished at a temperature within the range from about 800° F. to about 880° F., at a pressure within the range from about 1500 to about 2000 psia.

3. The improvement of claim 2 wherein the pressure variation is accomplished by cycling the pressure at an amplitude within the range from about 25 to about 100 psia and at a frequencey within the range from about 1 to about 3 cycles per minute.

4. The improvement of claim 1 wherein the pressure is cycled at an amplitude within the range from about 50 to about 100 psia.

5. The process of claim 1 wherein the liquefaction is accomplished in a plurality of stages and the first stage is subjected to pressure variation.

6. The process of claim 5 wherein each stage is subjected to pressure variation.

* * * * *